US008842054B2

(12) United States Patent
Zhang et al.

(10) Patent No.: US 8,842,054 B2
(45) Date of Patent: Sep. 23, 2014

(54) GRID ARRAY ANTENNAS AND AN INTEGRATION STRUCTURE

(75) Inventors: Yue Ping Zhang, Singapore (SG); Mei Sun, Singapore (SG)

(73) Assignee: Nanyang Technological University, Singapore (SG)

( * ) Notice: Subject to any disclaimer, the term of this patent is extended or adjusted under 35 U.S.C. 154(b) by 580 days.

(21) Appl. No.: 13/139,189

(22) PCT Filed: Dec. 12, 2008

(86) PCT No.: PCT/SG2008/000479
§ 371 (c)(1),
(2), (4) Date: Jun. 10, 2011

(87) PCT Pub. No.: WO2010/068178
PCT Pub. Date: Jun. 17, 2010

(65) Prior Publication Data
US 2011/0241969 A1 Oct. 6, 2011

(51) Int. Cl.
*H01P 1/19* (2006.01)

(52) U.S. Cl.
USPC ..... 343/853; 235/487

(58) Field of Classification Search
USPC ..... 343/853; 235/487, 492, 375
See application file for complete search history.

(56) References Cited

U.S. PATENT DOCUMENTS 3,290,668 A 12/1966 Kraus
3,290,688 A * 12/1966 Kraus ..... 343/731
4,376,938 A 3/1983 Conti et al.
4,535,337 A 8/1985 MacAnlis

FOREIGN PATENT DOCUMENTS

GB 2140974 A 12/1984

OTHER PUBLICATIONS

International Search Report and Written Opinion for International Application No. PCT/SG2008/000479 dated Feb. 23, 2009, 12 pages.
International Preliminary Report on Patentability for International Application No. PCT/SG2008/000479 dated Aug. 24, 2009, 6 pages.
James, J.R. et al., "Handbook of MIcrostrip Antennas," Peter Peregrinus Ltd., ISBN 0863411509, pp. 1040-1041, Mar. 6, 1990.
Alalusi, S. et al., a 60GHz Adaptive Antenna Array in CMOS, Ph.D. Dissertation, University of California, Berkeley, 2005.
Conti, R. et al., "The wire grid microstrip antenna," IEEE Trans. Antennas Propagat., vol. 29, No. 1, pp. 157-166, Jan. 1981.
Kawano, T. et al., "Cross-mesh array antennas for dual LP and CP waves," IEEE AP-S Int. Symp., pp. 2748-2751, 1999.

(Continued)

*Primary Examiner* — Karl D Frech
(74) *Attorney, Agent, or Firm* — Conley Rose, P.C.

(57) ABSTRACT

A grid array antenna configured to operate with millimeter wavelength signals, the grid array antenna comprising a plurality of mesh elements and at least one radiation element; each mesh element comprising at least one long side and at least one short side operatively connected to the at least one long side; at least one of: the at least one radiating element, the at least one short side, and the at least one long side having compensation for improved antenna output for improved antenna radiation.

26 Claims, 13 Drawing Sheets

(a)

(b)

(56) References Cited

OTHER PUBLICATIONS

J. D. Kraus, "A backward angle-fire array antenna," IEEE Trans. Antennas Propagat., vol. 12, No. 1, pp. 48-50, Jan. 1964.

Lamminen, A. E. I. et al., "60 GHz patch antennas and arrays on LTCC with embedded-cavity substrates," IEEE Trans. Antennas Propagat., vol. 56, No. 9, pp. 2538-2544, Sep. 2008.

Nakano, H. et al.,, "Center-fed grid array antennas," IEEE AP-S Int. Symp., pp. 2010-2013, 1995.

Nakano, H. et al., "Meander-line grid array antenna," Proc. Inst. Elect. Eng. Microwave Antennas Propag., vol. 145, No. 4, pp. 309-312, Aug. 1998.

Nakano, H. et al., "A cross-mesh array antenna," 11th International Conference on Antennas and Propagation, Apr. 17-20, 2001, Conference Publication No. 480.

Nakano, H. et al., "A modified grid array antenna radiating circularly polarized wave," IEEE 2007 International Symposium on Microwave, Antenna, Propagation, and EMC technologies for Wireless Communications, pp. 527-530.

Palmer, K. D. et al., "Synthesis of the microstrip wire grid array," IEE 10th Conference on Antennas and Propagation, pp. 114-118, Edinburgh, UK, Apr. 14-17, 1997.

Uchimura, H. et al., "Novel circular polarized antenna array substrates for 60GHz-band," IEEE MTT-S Int. Microwave Symp. Dig., pp. 1875-1878, Long Beach, CA, USA, Jun. 12-17, 2005.

* cited by examiner (a) (b) (c)

(a)
(PRIOR ART)

GRID ARRAY ANTENNAS AND AN INTEGRATION STRUCTURE

TECHNICAL FIELD

This invention relates to grid array antennas and an integration structure for grid array antennas and refers particularly, though not exclusively, to grid array antennas for use with millimeter wavelength signals, and a structure for the integration of such antennas.

BACKGROUND

The grid array antenna was first proposed by Kraus in 1964. Since then, there have been some studies conducted but all were at relatively low microwave frequencies. FIG. 1 shows the basic grid arrangement. It consists of rectangular meshes of microstrip lines on a dielectric substrate backed by a metallic ground plane and fed by a metal via through an aperture on the ground plane. Depending on the electrical length of the sides of the meshes, the grid array antenna may be resonant or non-resonant.

For a resonant grid array antenna, the sides of the meshes should be one wavelength by a half-wavelength in the dielectric, and the instantaneous currents would be out of phase on the long sides of the meshes and in phase on the short sides of the meshes, respectively. As a result, the long sides of the meshes behave as microstrip line elements and the short sides act as both radiating and microstrip line elements. The short sides will produce the main lobe of radiation in the boresight direction.

For a non-resonant grid array antenna, the length of the short side of the meshes can be slightly more than one-third wavelength and the length of the long side of the meshes should be two times longer but three times shorter than the length of the short side of the meshes in the dielectric. Assuming that it is fed from one end, the currents in the short sides of the meshes follow a phase progression producing the maximum radiation in a backward angle-fire direction.

FIG. 2 shows the method of amplitude control through control of microstrip line impedances (or microstrip line widths) to lower the first sidelobe.

The grid array antenna has caught considerable attention since the middle of 1990s. FIG. 3(*a*) to (*c*) show the proposed miniaturized grid array antenna by:

(a) "meandering" the long sides of the meshes;

(b) dual-linearly-polarized grid array antenna by crossing the meshes; and (c) a circularly-polarized grid array antenna by modifying the short sides of the meshes.

In addition, there has been developed a double-layer grid-array antenna. It consists of upper and lower grid array antennas, each being fed from its center terminal to radiate linearly-polarized waves. The upper and lower grid array antennas have the same configuration parameters. The orientation of the lower grid array antenna is rotated by 90° with respect to that of the upper grid array antenna. This perpendicular arrangement provides high isolation at both the center feeding terminals and results in one antenna radiating horizontally-polarized waves and the other antenna radiating vertically-polarized waves.

A cross-mesh array antenna is shown in FIG. 4. The radiation of circularly-polarized waves results from adding a layer of c-figured elements above the cross-mesh array antenna or feeding it at four terminals with signals of correct phase differences. The feeding terminals are shown in FIG. 4(*b*).

In the past, grid array antennas have been excited for single-ended signals. They may also be excited for differential signals. FIG. 5 illustrates a differential feeding scheme. One vertical (radiating) side of the center mesh is cut open with one end connected to the positive signal and the other end to the negative signal.

Typical antennas for millimeter wavelength signals are reflector, lens, and horn antennas. Reflector antenna technology has achieved the highest level of development for high gain applications. Lens antennas are a second high gain technology; while horn antennas limit gain to about 30 dBi due to construction limitations. Although these antennas all have a high gain, they are not suitable for commercial mm-wave radios because they are expensive, bulky, heavy and, more importantly, they cannot be integrated with solid-state devices. Printed, deposited or etched antenna arrays are used for mm-wave radio systems.

It has been proposed to use linearly-polarized mm-wave 60-GHz antenna arrays constructed on multilayer LTCC substrates. These antenna arrays use 4×4 microstrip patch radiating elements fed by a quarter-wavelength matched T-junction network and a Wilkinson power divider network, respectively. The measured results indicate that the antenna array fed by the matched T-junction network performs better than that fed by the Wilkinson power divider. The measured impedance bandwidths are 9.5% and 5.8% and maximum gains are 18.2 dBi and 15.7 dBi, respectively, for the antenna arrays with and without an embedded cavity.

Some antenna arrays have achieved wide bandwidth by three major technologies: original antenna element, laminated waveguide and design method to adjust axial ratio of circular polarization. The antenna element has laminated resonator structure formed by filled via-holes and conductive pattern, which generate wide bandwidth characteristics. Measurement results show that the array of 6×8 radiating elements has a sidelobe level less than −15 dB, gain variation less than 1 dB around 19 dBi and axial ratio less than 3 dB over a bandwidth more than 4 GHz.

Due to the selection of a microstrip patch and a slot as radiating elements, available antenna arrays require complex feeding networks, sophisticated process techniques, and additional embedded cavities to achieve the required performance. Also, available antenna arrays, if intended to be connected with differential radios, will require a feeding network that would become even more complex. Differential radios are more dominant than single-ended radios in highly-integrated mm-wave radios. Furthermore, the available antenna arrays provide an antenna function to the millimeter-wave radio devices. Hence, one can conclude that the available antenna arrays are yet not suitable for highly-integrated mm-wave 60-GHz radios because of their high cost and lower functionality.

It is known that for a resonant grid array antenna the instantaneous currents should be in phase on the short sides of the meshes. As such, the phasing of the radiating elements (short sides of the meshes) is critical. FIG. 8 shows instantaneous current distribution on the grid array antenna at 60-GHz. It is evident from the figure that the phase synchronism is only realized for the radiating elements between the two bars of dashed lines. Hence, the conventional grid array antenna will not perform well at mm-wave frequencies. Phase compensation schemes must be devised for mm-wave grid array antennas.

SUMMARY

According to an exemplary aspect there is provided a grid array antenna configured to operate with millimeter wavelength signals, the grid array antenna comprising a plurality of mesh elements and at least one radiation element; each mesh element comprising at least one long side and at least one short side operatively connected to the at least one long side; at least one of:

the at least one radiating element, the at least one short side, and the at least one long side having compensation for improved antenna output for improved antenna radiation.

The compensation may comprise an integrated element being at least one selected from: an inductor, a capacitor, and a resonator. The compensation may comprise a differential feeding network comprising a first terminal and a second terminal. The first terminal and the second terminal may each be operatively connected to an end of the at least one radiating element. The first terminal and the second terminal may be separated by at least a half guided wavelength. The first terminal and the second terminal may be connected at each end of the same radiating element; or the first terminal may be connected to a first radiating element's inner end, and the second terminal may be connected to a second radiating element's inner end. The first terminal and the second terminal may be separated by one and a half guided wavelengths. The compensation may comprise a patterned ground plane comprising reflective metal patches aligned with each of the at least one short sides. The at least one long side and the at least one short side may be inclined relative to each other to form mesh elements shaped as a parallelogram. A second grid array antenna may form a second layer parallel to the grid array antenna. The grid array antenna may comprise a wire grid array, and the second grid array antenna may comprise a slot grid array. The wire grid array and the slot grid array may be oriented at a relative rotation of 90° and their short sides may be relatively offset. The second grid antenna array and the grid array antenna may be parasitic of each other. The grid array antenna may further comprise a third layer as a ground plane and fences of vias to provide a cavity-back grid array. A tooth may be provided projecting perpendicularly from each of the at least one short sides and the at least one radiating element. Each of the short sides may comprise one of the at least one radiating element and each of the long sides may comprise a feeding element.

According to another exemplary aspect there is provided an adaptive array antenna comprising at least two grid array antennas as described above. the adaptive array antenna may further comprise a DC feeding network operatively connected to a long side of the at least one grid array antenna at an inclined angle.

According to a further exemplary aspect there is provided a package comprising at least one grid array antenna as described above, the package comprising four laminated layers; a first layer comprising an antenna layer; a second layer with a first opening; a third layer with a second opening; and a fourth layer with a third opening; the first, second and third opening forming a cavity for a die.

The second opening may be larger than the first opening, and the third opening may be larger than the second opening. The first opening, the second opening and the third opening may all be aligned. The package may further comprise an adaptive array antenna as described above.

According to yet a further exemplary aspect there is provided a package comprising an adaptive array antenna as described above.

According to a penultimate exemplary aspect there is provided a package comprising at least one grid array antenna as described above, the packing comprising three co-fired laminated layers; the three co-fired laminated layers comprising: an antenna layer; a second layer having feeding traces comprising at least one of differential antenna feeding traces, and a single-ended feeding trace; and a third layer comprising a ground of the feeding traces and signal traces.

The differential feeding traces may comprise two quasi-coaxial cables cascaded with two striplines, another two quasi-coaxial cables, and vias through two apertures on the ground plane. The feeding traces may be in a GSGSG arrangement. The single-ended feeding trace may comprise a quasi-coaxial cable cascaded with a via through one aperture on the ground plane. The single-ended feeding trace may comprise a GSG arrangement. The package may further comprise an adaptive array antenna as described above.

According to a final exemplary aspect there is provided a chip-scale package comprising a system printed circuit board drawing an open cavity in surface thereof for housing and protecting a die mounted therein, the die comprising a package as described above.

BRIEF DESCRIPTION OF THE DRAWINGS

In order that the invention may be fully understood and readily put into practical effect there shall now be described by way of non-limitative example only exemplary embodiments, the description being with reference to the accompanying illustrative drawings.

In the drawings.

DETAILED DESCRIPTION OF EXEMPLARY EMBODIMENTS

Figure 1:
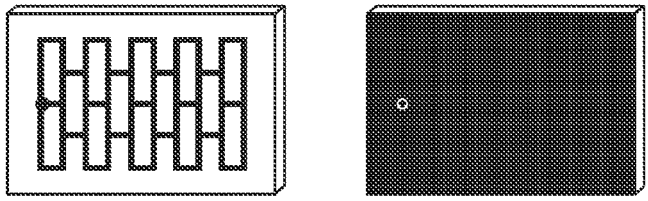
FIG. 1 (PRIOR ART)
FIG. 1 is an illustration of a prior art grid array antenna with (a) top view and (b) bottom view.
Figure 2:
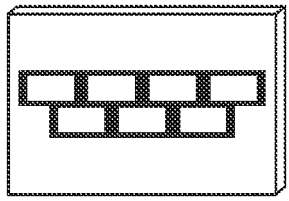
FIG. 2 (PRIOR ART)
FIG. 2 is an illustration of a prior art grid array antenna with a amplitude control.
Figure 3:
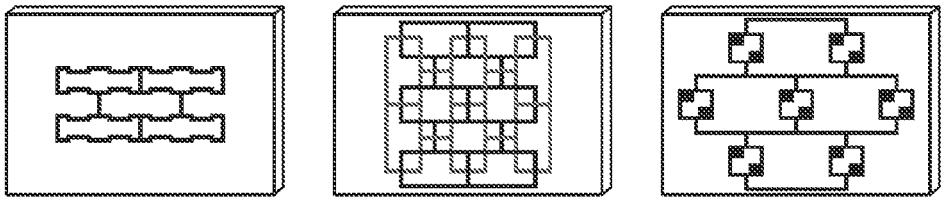
FIG. 3 (PRIOR ART)
FIG. 3 is three illustrations of three prior art grid array antennas.
Figure 4:
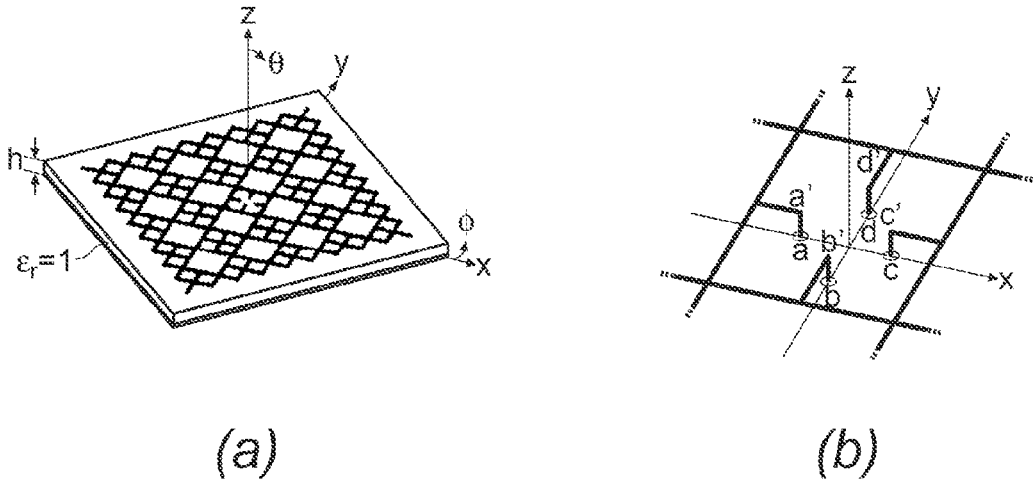
FIG. 4 (PRIOR ART)
FIG. 4 is an illustration of a prior art cross-mesh array antenna and its feeding terminals.

Throughout the description common reference numerals are used for like components with a prefix number being the drawing figure number.

Figure 8:
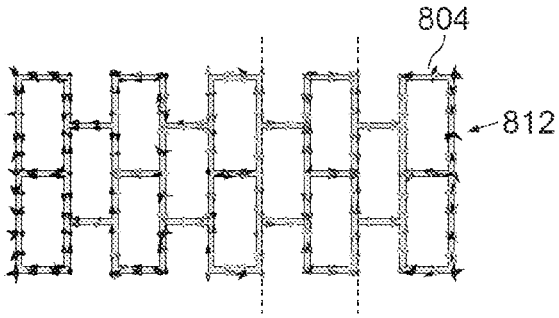
FIG. 8 (PRIOR ART)
FIG. 8 is an illustration of the instantaneous current distribution in a prior art grid array antenna.
Figure 9:
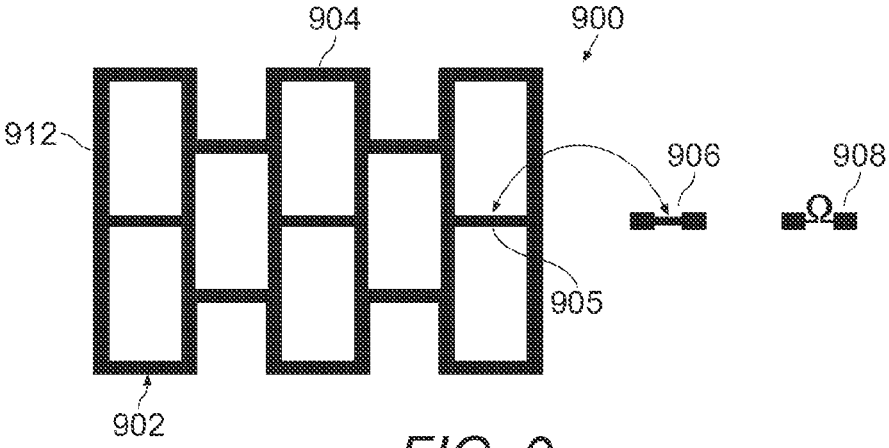
FIG. 9 is an illustration of an exemplary embodiment with phase compensation using inductors.
Figure 10:
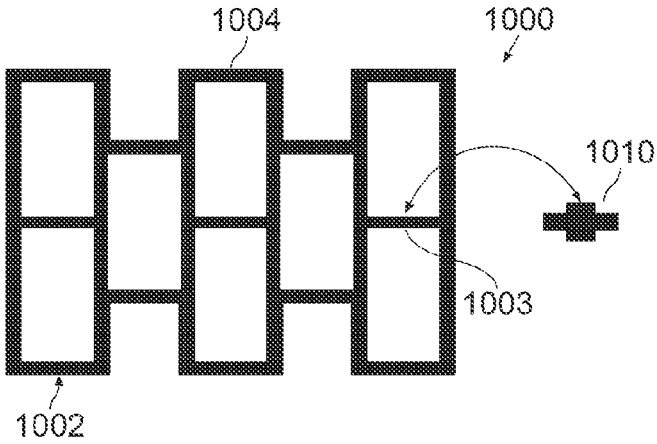
FIG. 10 is an illustration of an exemplary embodiment using capacitors.

With reference to FIG. 8, the phase of the radiating elements can be adjusted by changing the electrical length of both long and short sides of the meshes outside the two bars. The phase of both feeding and radiating elements can also be compensated by using phase shifters or amplifiers. For example, inverting amplifiers can be used for compensating both phase and amplitude. An inductor or a capacitor or a resonator can be considered as a passive phase shifter. Except using discrete chip-type inductors, or capacitors, or resonators, it is preferred to use integral elements. The use of integral inductors is shown in FIG. 9 for a single-layer grid-array antenna 900. The antenna 900 has elements or meshes 902 with short sides 904 and long sides 912. One or more of the short sides 904 are radiating elements. One or more of the radiating elements 904 has integral inductors 906 or 908. The long sides 912 are feeding elements. One or more of the long sides/feeding elements 912 may also have integral inductors 906 or resonators 908. Multi-layer or stacked inductors may be used. In addition, one or more of the short sides 904 may also be radiating elements. The use of integral capacitors 1010 is shown in FIG. 10 for a single-layer grid-array antenna 1000. Again multi-layer or stacked capacitors may be used.

The combination of integral inductors 906 and capacitors 1010 shown in FIGS. 9 and 10 will yield integral resonators.

After using an EM simulator to understand the phase conditions of a design the phase adjusters may be added where phases need to be adjusted.

Figure 11:
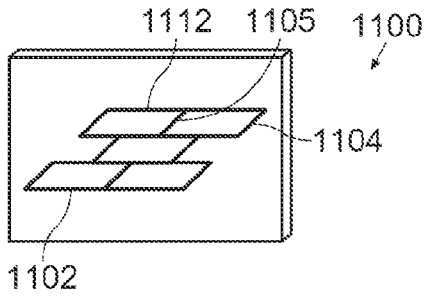
FIG. 11 is an illustration of an exemplary embodiment of a 45° linearly-polarized grid array antenna.

In addition to the above-phase compensation, the use of 45° linear polarization may be used in millimeter wavelength car radar applications as radiation with orthogonal polarization from cars coming from the opposite direction does not affect the radar operation. FIG. 11 shows a 45° linearly-polarized grid array antenna 1100 where the angle between the long sides 1112 and the short sides 1104 of the meshes 1102 is to 45°/135° to form meshes 1102 shaped as a parallelogram. However, other angles may be used as required or desired.

Figure 12:
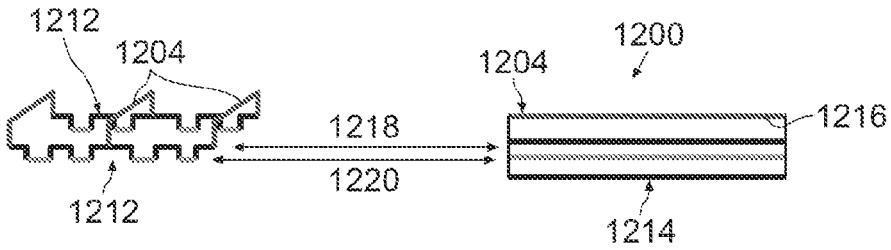
FIG. 12 is an illustration of an exemplary embodiment of a miniaturized grid array antenna using multiple-layers.

FIG. 12 shows a miniaturized grid array antenna 1200 where the long sides 1212 are stepped and the short sides 1204 are bent in a multi-layer metal structure. The bending makes the large part of the short sides 1204 of the meshes 1202 further from the ground plane 1214, which may improve radiation. The short sides 1204 may be in a first layer 1216; and the long sides 1212 may be in two different layers 1218, 1220. The layers 1216, 1218 and 1220 may be connected by use of metal lines on the same layer created by, for example, a known printing technique. Metal lines on different layers may be connected by using metal vias.

Figure 13:
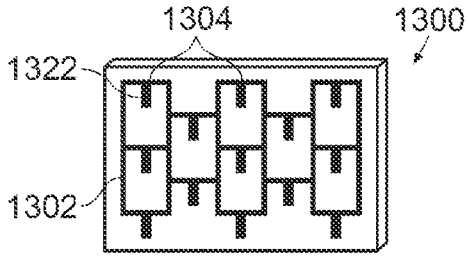
FIG. 13 is an illustration of an exemplary embodiment of a circularly-polarized grid array antenna.

FIG. 13 shows circularly-polarized grid array antenna 1300. Each short side 1304 and radiating element 1305 of a mesh 1302 has an added tooth 1322. Each tooth 1322 extends generally perpendicularly to the short side 1304 and radiating element 1305. All teeth 1322 are oriented in the same direction relative to the respective short side 1304 and radiating element 1305. The position of the tooth 1322 means that the current on the tooth has a 90° phase difference with respect to the current on the short side 1304 or radiating element 1305 to which the tooth 1322 is connected. The width of the tooth 1322 can be adjusted so that the current on the tooth has the same amplitude as that on the short side 1304 or radiating element 1305 to which the tooth 1322 is connected. Each tooth 1322 may be of a length of about a quarter guided wavelength of half length of the short side 1304. The grid array antenna 1300 shown in FIG. 13 gives right-hand circular polarization. Rotating the teeth 1322 180° relative to the respective short sides 1304 and radiating elements 1305 will produce left-hand circular polarization.

Figure 14:
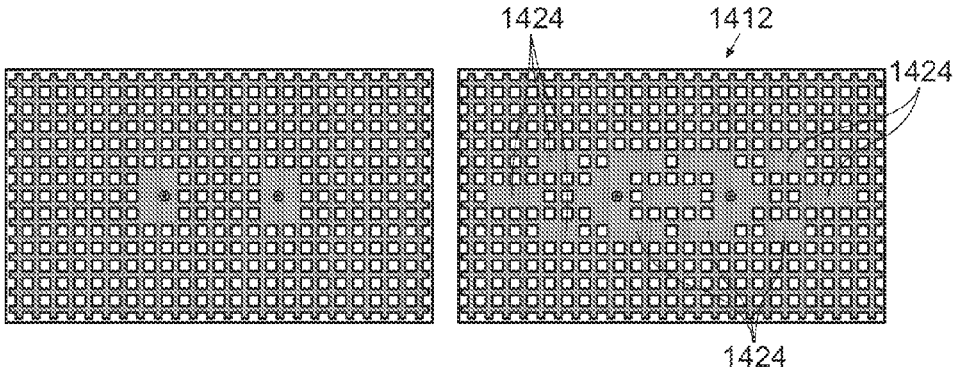
FIG. 14 is an illustration of (a) a conventional meshed ground plane and (b) an exemplary embodiment of a ground plane.

A grid array antenna usually uses a solid, flat ground-plane. It has been proposed that the ground plane may be curved or corrugated; or may be a screen or a grid with holes or perforations whose peripheral length is less than one-half wavelength. Preferably, the holes have a peripheral long that is much less than one-half wavelength. The meshed ground plane required for mechanical reliability is structurally similar to a perforated ground plane. A prior art meshed ground plane shown in FIG. 14*a*. It shifts the resonant frequency downward, expands the impedance bandwidth, and decreases the antenna gain. The exemplary patterned ground plane shown in FIG. 14*b* shifts the resonant frequency downward and expands the impedance bandwidth with a reduced penalty in antenna gain penalty. This is because the short sides 1404 of the meshes 1402 are radiating elements. Metal patches 1424 are added to the meshed ground plane 1414 under the short sides 1404 to act as reflectors so that the backward leakage field can be reduced. As a result, the antenna gain penalty is reduced.

Figure 15:
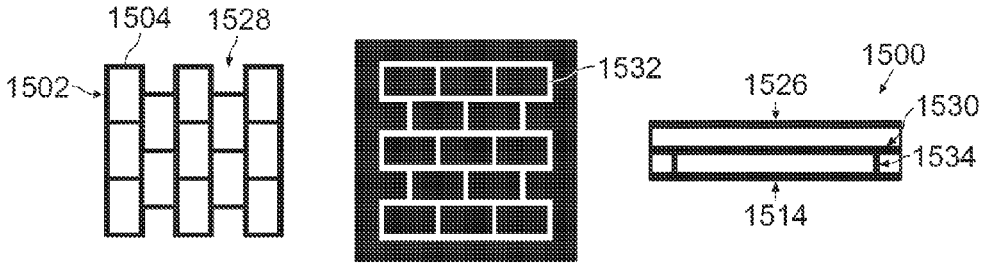
FIG. 15 is an illustration of an exemplary embodiment of a double-layer grid array antenna with (a) wire grid array, (b) slot grid array and (c) cross-section.

Antennas in multi-layer structures have a size advantage. However, known double-layer grid array antennas do not fully offer this advantage because the upper and lower grid array antennas have the same configuration parameters. However, the lower grid array antenna is rotated by 90° with respect to that of the upper grid array antenna. FIG. 15 shows a two-layer grid-array antenna 1500 having an upper layer 1526 containing a wire grid array radiating element 1528; and a lower layer 1530 with a slot grid array radiating element 1532. A third layer 1514 functions as the reflector. The lower layer 1530 also functions as the ground plane for the wire grid array radiating element 1528 as a wire grid array antenna. The reflector 1514 works with the lower slot grid array radiating element 1532 as a slot grid array antenna. Furthermore, a quasi-cavity is formed under the slot grid array radiating element 1532 by connecting the ground on the lower layer 1530 to the bottom reflector layer 1514 with fences of vias 1534. This gives a cavity-back slot grid array antenna. The upper wire grid array 1528 and lower slot grid array 1532 antennas are parasitic to each other. The polarization of the double-layer grid antenna 1500 depends on the mutual orientation. For the orientation shown in FIG. 15, both wire 1528 and slot 1532 grid array antennas radiate the same linearly-polarized wave. However, if either wire 1528 or slot 1532 grid array rotates by 90° and if the short sides 1504 of the meshes 1502 of both wire 1528 and slot 1532 grid arrays are offset as if there was no offset, the radiation of slot grid array would be blocked by the wire grid array. Offset may also enhance the radiation of the wire grid array antenna as less radiation may be leak to the quasi-cavity. As such one radiates the linearly-horizontally-polarized waves and the other radiates linearly-vertically-polarized waves. No offset will deteriorate the radiation. Angles other than 90° may be used as required or desired.

Figure 5:
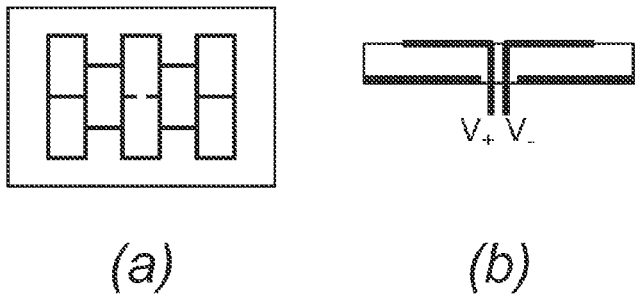
FIG. 5 (PRIOR ART)
FIG. 5 is an illustration of a prior art grid array antenna and its differential feeding system.
Figure 6:
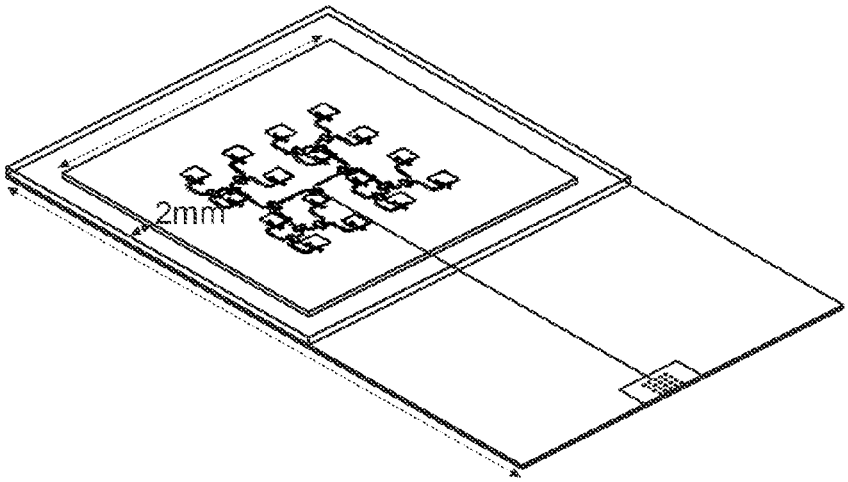
FIG. 6 (PRIOR ART)
FIG. 6 is an illustration of a prior art antenna array and its different feeding networks.
Figure 6:
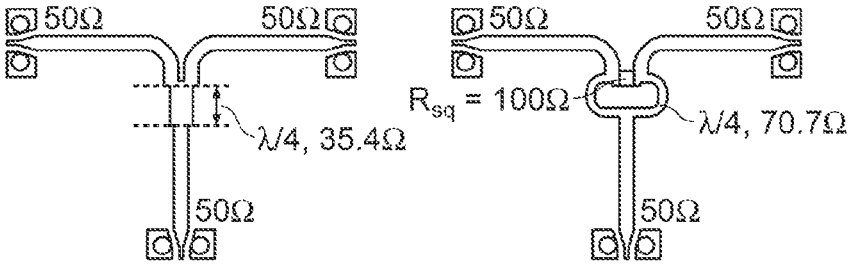
FIG. 6 (PRIOR ART)
Figure 7:
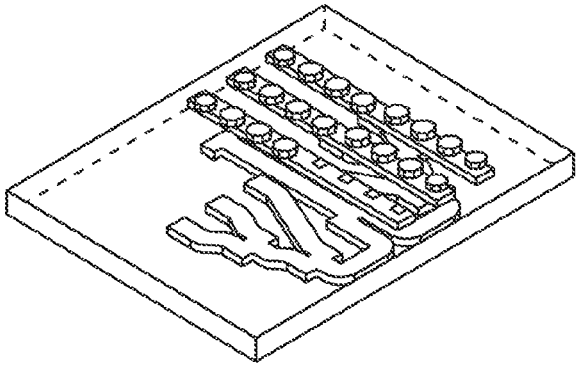
FIG. 7 (PRIOR ART)
FIG. 7 is an illustration of a prior art antenna array with (a) its internal structure and (b) antenna element on the first feeding line.
Figure 7:
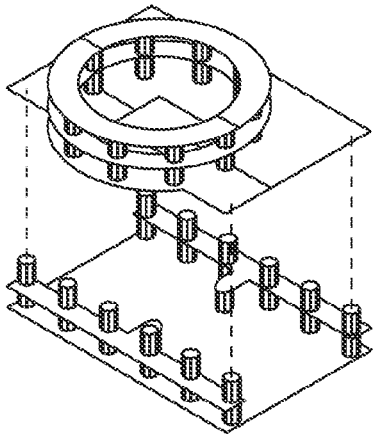
FIG. 7 (PRIOR ART)
Figure 16:
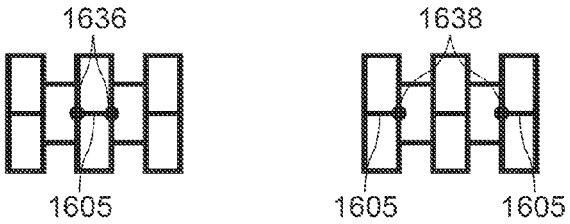
FIG. 16 is two illustrations of two exemplary embodiments of differential feeding systems.

As shown in FIG. 5, known differential feeding structures cut the center radiating element 505. The two feeding terminals are close, so the isolation is poor. Also the excitation efficiency is not good. FIG. 16 shows two differential feeding terminal locations. In FIG. 16(*a*) the differential feeding terminals 1636 are connected to each end of the central radiating element 1605 and are a half guided wavelength apart. In FIG. 16(*b*) the differential feeding terminals 1638 are connected to the wider ends of two different radiating elements 1605 and are one-and-half guided wavelengths apart. The two terminals 1636 or 1638 are separated by at least a half guided wavelength. As such, the isolation is good, and so is the excitation efficiency.

Figure 17:
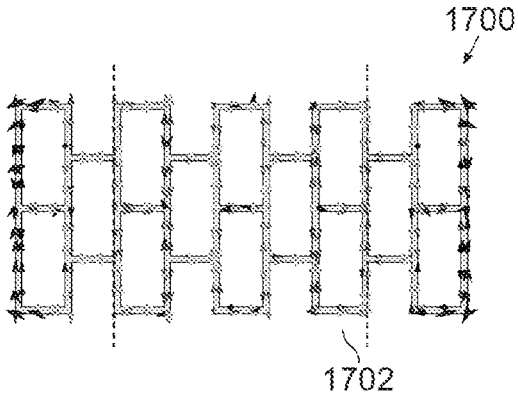
FIG. 17 is an illustration of the instantaneous current distribution in the antenna of FIG. 16(*b*)

FIG. 17 shows the instantaneous current distribution on a grid array antenna 1700 fed for differential operation according to FIG. 16(*b*). Differential feeding results in a better phase synchronism among more mesh elements 1702.

Figure 18:
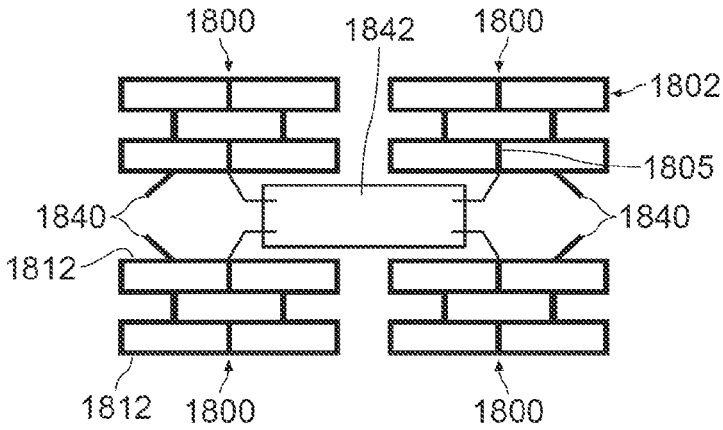
FIG. 18 is an illustration of an exemplary adaptive array antenna using exemplary embodiments of grid array antenna elements and as part of a DC feeding network.

The grid array antenna can be used as a basic element to design an adaptive array antenna or a switched beam array antenna. FIG. 18 illustrates the use of grid array antenna elements 1800 for an adaptive array antenna for use in, for example, highly-integrated radios. The grid array antenna elements 1800 have a wider impedance bandwidth and are also suitable to be DC-coupled. For example, the DC signals can be easily supplied from the middle of the long sides 1812 of the meshes 1802 as shown in FIG. 18. The DC lines 1840 should have high impedance to high-frequency signals; and are preferably inclined relative to the long sides 1812 to minimize the effect on the antenna radiation. The angle of inclination should be in the range 40° to 50°.

Figure 19:
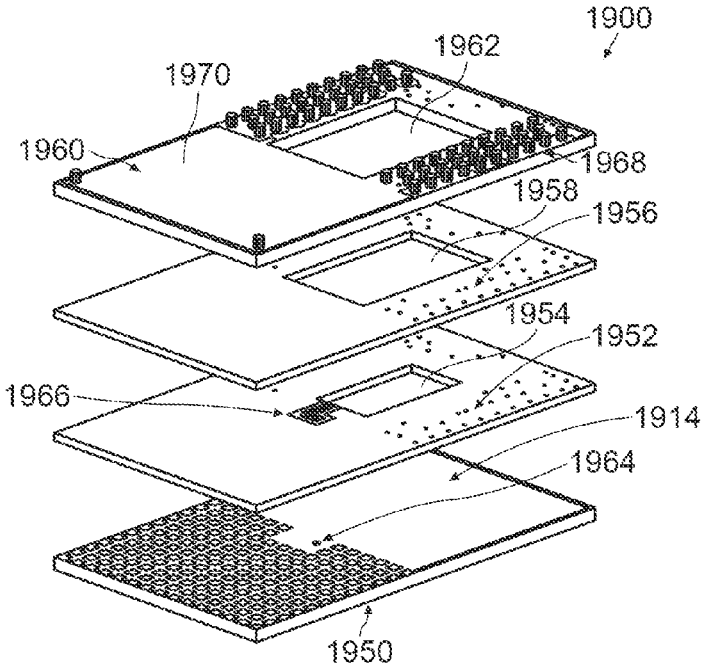
FIG. 19 is an exploded perspective view of an exemplary grid array antenna with a ball grid array for wire bonding interconnects.
Figure 20:
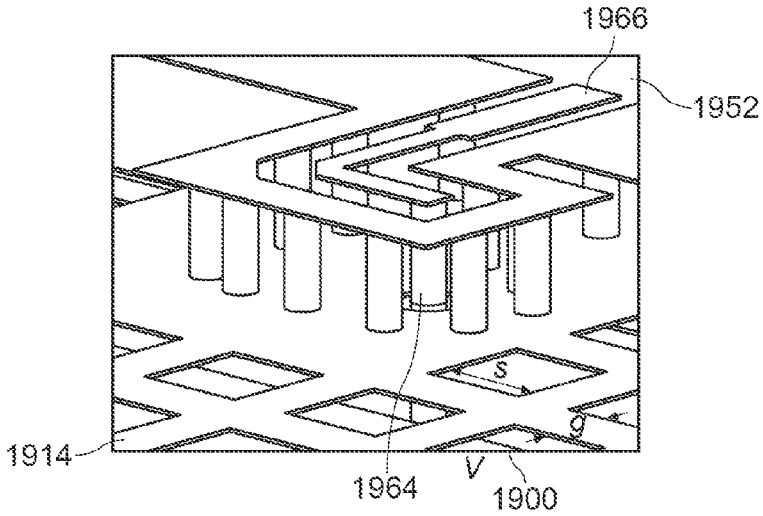
FIG. 20 is a close-up view of the antenna feed structure of FIG. 19.

A first way of integration of the grid array antenna 1900 in a ball grid array 1968 package for wire-bonding interconnect is shown in FIGS. 19 and 20. The package features standard wire bonding and there are four laminated layers for the package. The first layer 1950 is the antenna layer with the antenna being underneath and therefore is not shown. The ground plane 1914 is shown as is a feed via 1964 for the antenna feed. The second layer 1952 has an opening 1954 and, the third layer 1956 has a slightly larger opening 1958. The fourth layer 1960 has the largest opening 1962. The three openings 1954, 1958 and 1962 are all aligned. The traces of the second layer 1952 and the third layer 1956 are not shown. The openings 1954, 1958 and 1962 form a three-tier cavity that can house the radio die.

There are also five metallic layers for the package. A first layer provides the grid array antenna 1900, the second layer is for the partly meshed antenna ground plane 1914, and the next two metal layers are in the second and third layers 1952, 1956 with one being for the antenna feeding traces and the other for signal traces. The final metal layer is for the package ground plane 1970, as well as being for solder ball pads 1968.

Figure 21:
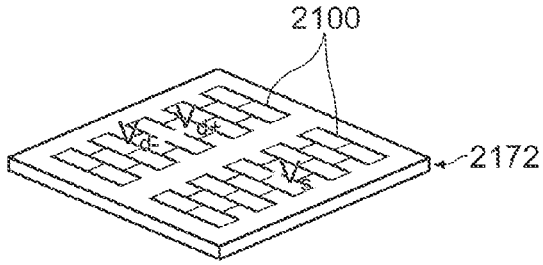
FIG. 21 is (a) top and (b) bottom views of an exemplary chip-scale package with dual grid-array antennas.
Figure 21:
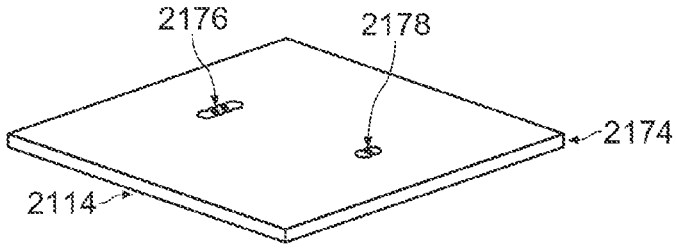

Another way of integration of dual grid array antennas 2100 (one antenna 2100 for transmission and the other antenna 2100 for reception) in a chip-scale package for flip-chip bonding is shown in FIG. 21. There are three co-fired laminated layers for the package. The top antenna layer 2172 is a single layer and the bottom layer 2174 contains two laminated layers. There are also four metallic layers for the package. The top layer 2172 has the dual grid array antennas 2100 and the patterned ground plane 2114. The second layer 2174 has the differential antenna feeding traces 2176, and the single ended feeding trace 2178; and the third layer has the ground of the antenna feeding traces, and the signal traces (not shown). The die is flip-chip bonded to the signal traces.

Figure 22:
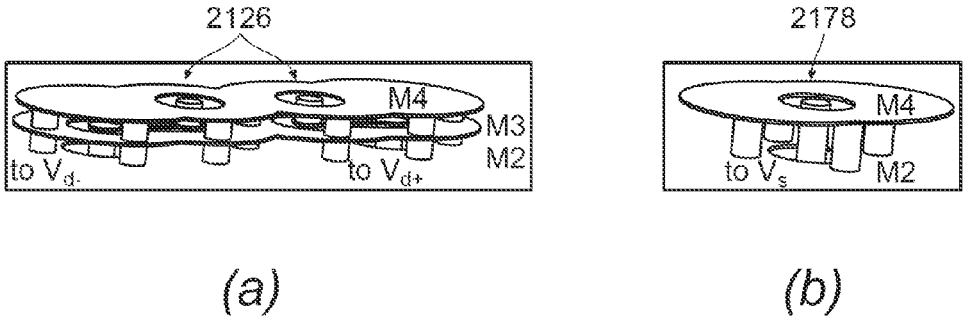
FIG. 22 is a close-up view of the antenna feeding structure of FIG. 21.

FIG. 22 shows the feeding networks of the dual grid array antennas 2100. For the dual-feed trace 2126, FIG. 22(*a*) shows two quasi-coaxial cables cascaded first with two strip-lines, then another two quasi-coaxial cables, and finally vias through two apertures on the ground plane in a GSGSG arrangement. For the single-feed trace 2178, FIG. 22(*b*) shows a quasi-coaxial cable cascaded with via through one aperture on the ground plane in a GSG arrangement. The GSG and GSGSG arrangements not only minimize potential electromagnetic interference but also improve the feeding performance. The GSG and GSGSG feeding networks are designed together with the grid array antenna 2100.

Figure 23:
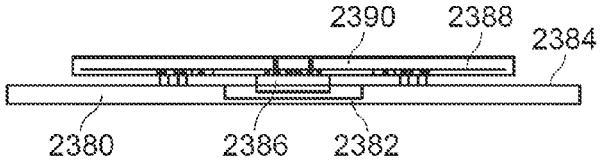
FIG. 23 is a schematic side view of an exemplary embodiment of a grid-array antenna assembled with a system printed circuit board.

FIG. 23 illustrates the assembling the antenna in a chip-scale package with the system printed-circuit board (PCB) 2380. An open cavity 2382 is formed in the top surface 2384 of the PCB 2380 to house and protect the die 2386. The lands 2388 on the chip package 2390 are soldered to the PCB 2380 to complete the interconnects from the chip package 2390 to the PCB 2380 through the package 2390.

The wire-bonding technique is well established in consumer electronics. A bond wire functions as a series inductor which will drastically increase the loss as the frequency or the length are increased. Interconnection using the flip-chip technique has better performance than using the wire-bonding technique because the bump height is kept smaller than the length of the bond wire and the bump diameter is thicker than that of the bond wire.

Although both resonant and non-resonant grid array antennas are useful for many applications, the disclosed resonant grid array antenna is for millimeter wavelength signals. The design determines the dielectric substrate dimensions, the number of meshes, the microstrip line impedances, and the excitation location with the associated diameters of the metal via and the aperture. The grid array antennas may operate maybe, for example, 61.5 GHz with a maximum gain of ≥10 dBi. The impedance and radiation bandwidth is 7 GHz. The efficiency may be ≥80% for IEEE 802.15.3c standard applications.

Figure 24:
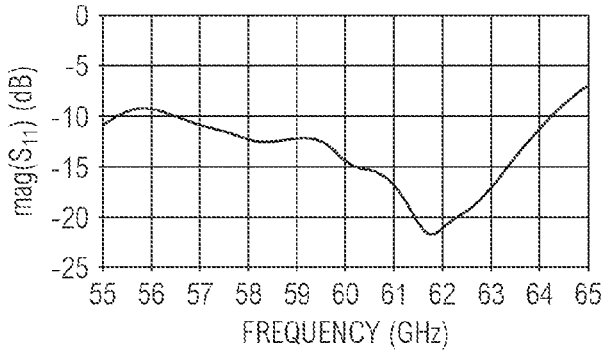
FIG. 24 shows the simulated performance of (a) S11, (b) gain and (c) radiation pattern for the exemplary embodiment of FIGS. 19 and 20.
Figure 24:
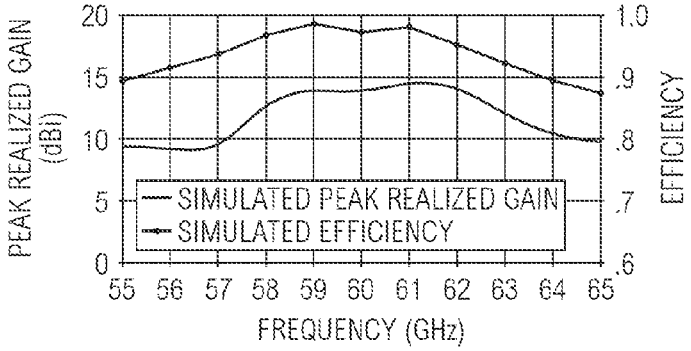
Figure 24:
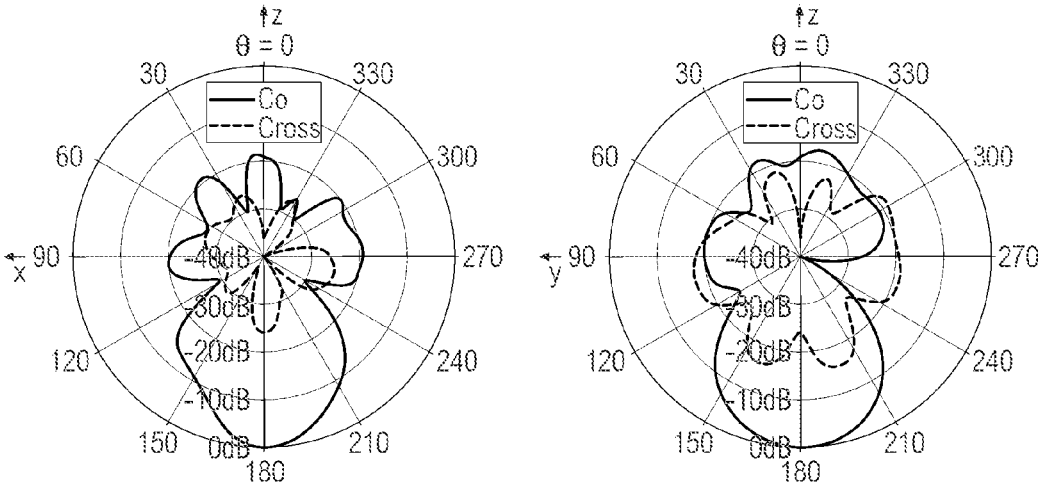
Figure 25:
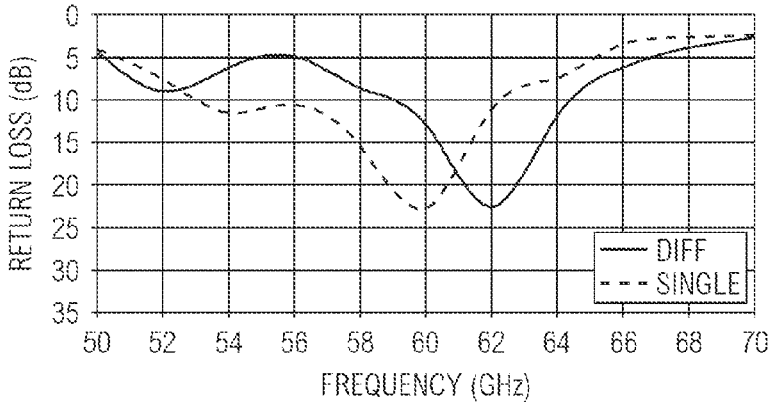
FIG. 25 shows the simulated performance for the exemplary embodiment of FIGS. 21 and 22.
Figure 25:
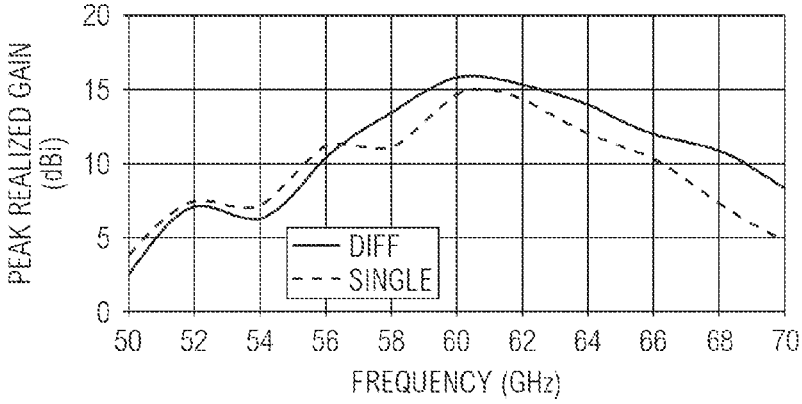
Figure 25:
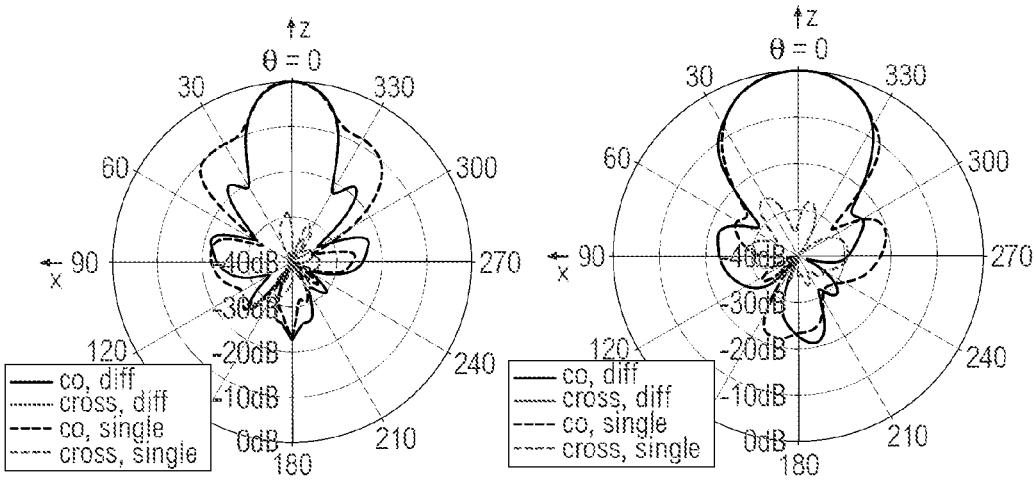

FIGS. 24 and 25 show the simulated performance of the two examples of FIGS. 19 and 21.

Whilst there has been described in the foregoing description exemplary embodiments, it will be understood by those skilled in the technology concerned that many variations in details of design, construction and/or operation may be made without departing from the present invention.

The invention claimed is:

1. A grid array antenna configured to operate with millimeter wavelength signals, the grid array antenna comprising a plurality of mesh elements and at least one radiation element; each mesh element comprising at least one long side and at least one short side operatively connected to the at least one long side; at least one of:

the at least one radiating element, the at least one short side, and the at least one long side having compensation for improved antenna output for improved antenna radiation;

wherein the compensation comprises a differential feeding network comprising a first terminal and a second terminal, the first terminal and the second terminal each being operatively connected to an end of the at least one radiating element; the first terminal and the second terminal being separated by at least a half guided wavelength.

2. A grid array antenna as claimed in claim 1, wherein the compensation comprises an integrated element being at least one selected from the group consisting of: an inductor, a capacitor, and a resonator.

3. A grid array antenna as claimed in claim 1, wherein the first terminal and the second terminal are connected at each end of the same radiating element.

4. A grid array antenna as claimed in claim 1, wherein the first terminal is connected to a first radiating element's inner end, and the second terminal is connected to a second radiating element's inner end; the first terminal and the second terminal being separated by one and a half guided wavelengths.

5. A grid array antenna as claimed in claim 1, wherein the compensation comprises a patterned ground plane comprising reflective metal patches aligned with each of the at least one short sides.

6. A grid array antenna as claimed in claim 1, wherein the at least one long side and the at least one short side are inclined relative to each other to form mesh elements shaped as a parallelogram.

7. A grid array antenna as claimed in claim 1, wherein a second grid array antenna forms a second layer parallel to the grid array antenna.

8. A grid array antenna as claimed in claim 7, wherein the grid array antenna comprises a wire grid array, and the second grid array antenna comprises a slot grid array.

9. A grid array antenna as claimed in claim 8, wherein the wire grid array and the slot grid array are oriented at a relative rotation of 90° and their short sides are relatively offset.

10. A grid array antenna as claimed in claim 7 wherein the second grid antenna array and the grid array antenna are parasitic of each other.

11. A grid array antenna as claimed in claim 7 further comprising a third layer as a ground plane and fences of vias to provide a cavity-back grid array.

12. A grid array antenna as claimed in claim 1, wherein a tooth is provided projecting perpendicularly from each of the at least one short sides and the at least one radiating element.

13. A grid array antenna as claimed in claim 1, where each of the short sides comprises one of the at least one radiating element and each of the long sides comprises a feeding element.

14. An adaptive array antenna comprising at least two grid array antennas as claimed in claim 1.

15. An adaptive array antenna as claimed in claim 14 further comprising DC feeding network operatively connected to a long side of the at least one grid array antenna at an inclined angle.

16. A package comprising an adaptive array antenna as claimed in claim 14.

17. A package comprising at least one grid array antenna as claimed in claim 1, the package comprising four laminated layers; a first layer comprising an antenna layer; a second layer with a first opening; a third layer with a second opening; and a fourth layer with a third opening; the first, second and third opening forming a cavity for a die.

18. A package as claimed in claim 17, wherein the second opening is larger than the first opening, and the third opening is larger than the second opening.

19. A package as claimed in claim 17, wherein the first opening, the second opening and the third opening are all aligned.

20. A package as claimed in claim 17 further comprising an adaptive array antenna as claimed in claim 14 or claim 15.

21. A package comprising at least one grid array antenna as claimed in claim 1, the packing comprising three co-fired laminated layers; the three co-fired laminated layers comprising: an antenna layer; a second layer having feeding traces comprising at least one of differential antenna feeding traces, and a single-ended feeding trace; and a third layer comprising a ground of the feeding traces and signal traces.

22. A package as claimed in claim 21, wherein the differential feeding traces comprise two quasi-coaxial cables cascaded with two striplines, another two quasi-coaxial cables, and vias through two apertures on the ground plane.

23. A package as claimed in claim 22, wherein the feeding traces are in a GSGSG arrangement.

24. A package as claimed in claim 21, wherein the single-ended feeding trace comprises a quasi-coaxial cable cascaded with a via through one aperture on the ground plane.

25. A package as claimed in claim 24, wherein the single-ended feeding trace comprises a GSG arrangement.

26. A chip-scale package comprising a system printed circuit board drawing an open cavity in surface thereof for housing and protecting a die mounted therein, the die comprising a package as claimed in claim 21.

* * * * *